US006641506B1

(12) United States Patent
Yang

(10) Patent No.: US 6,641,506 B1
(45) Date of Patent: Nov. 4, 2003

(54) WALKING MACHINE HAVING TWO FOOTBOARDS CAPABLE OF SWIVELING LATERALLY

(76) Inventor: Chang-Hsin Yang, No. 13, Lane 95, Tian Ren St., Shalu Town, Taichung Hsien (TW)

( * ) Notice: Subject to any disclaimer, the term of this patent is extended or adjusted under 35 U.S.C. 154(b) by 0 days.

(21) Appl. No.: 10/154,267

(22) Filed: May 24, 2002

(51) Int. Cl.[7] ..... A63B 22/04

(52) U.S. Cl. ..... 482/52; 482/115; 482/116

(58) Field of Search ..... 482/51, 52, 110, 482/114–116, 121, 122, 127, 148

(56) References Cited

U.S. PATENT DOCUMENTS 6,077,202 A * 6/2000 Gray ..... 482/57

* cited by examiner

*Primary Examiner*—Nicholas D. Lucchesi
*Assistant Examiner*—Tam Nguyen
(74) *Attorney, Agent, or Firm*—Harrison & Egbert

(57) ABSTRACT

A walking machine includes a base, two swivel devices, two footboards movable in sideway directions, a connection transmission device, two recovery transmission devices, and a damping device. The footboards are driven by two feet of an exerciser to actuate the two swivel devices such that two support arms of the swivel devices actuate the two recovery transmission devices, thereby causing two transmission elements of the recovery transmission devices to act on the damping device via the connection transmission device.

4 Claims, 10 Drawing Sheets

WALKING MACHINE HAVING TWO FOOTBOARDS CAPABLE OF SWIVELING LATERALLY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise machine, and more particularly to a walking machine designed for use in the practice of walking at a steady pace as a form of exercise.

BACKGROUND OF THE INVENTION

The conventional walking machine comprises a left footboard and a right footboard, which are capable of a back-and-forth movement only. In view of lack of variation in motion of the two footboards, the conventional walking machine is prone to failure in sparking interest of an exerciser. In other words, the conventional walking machine is not versatile enough to catch the fancy of the consumer at large.

BRIEF SUMMARY OF THE INVENTION

The primary objective of the present invention is to provide a walking machine which is versatile in design so as to satisfy the increasingly demanding consumers.

In keeping with the principle of the present invention, the foregoing objective of the present invention is attained by the walking machine comprising two footboards, two swivel devices, two recovery transmission devices, one connection transmission device, and one damping device. The two swivel devices are driven by the two footboards to actuate the two recovery transmission devices, which in turn actuate the damping device via the connection transmission device. The two footboards of the walking machine of the present invention share with the same damping device.

The features and the advantages of the present invention will be more readily understood upon a thoughtful deliberation of the following detailed description of the present invention with reference to the accompanying drawings.

DETAILED DESCRIPTION OF THE INVENTION

Figure 1:
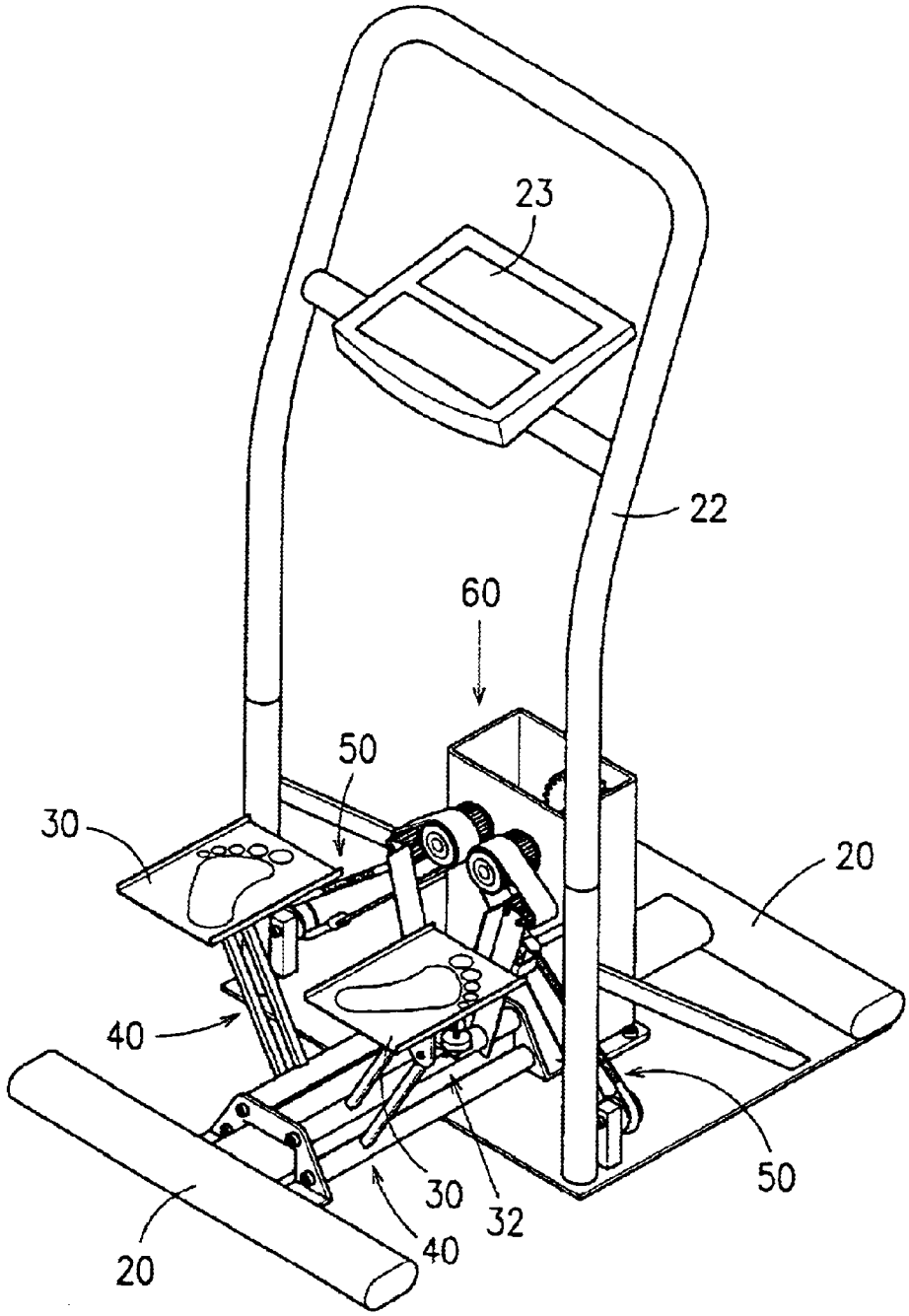
FIG. 1 shows a perspective view of the present invention.
Figure 2:
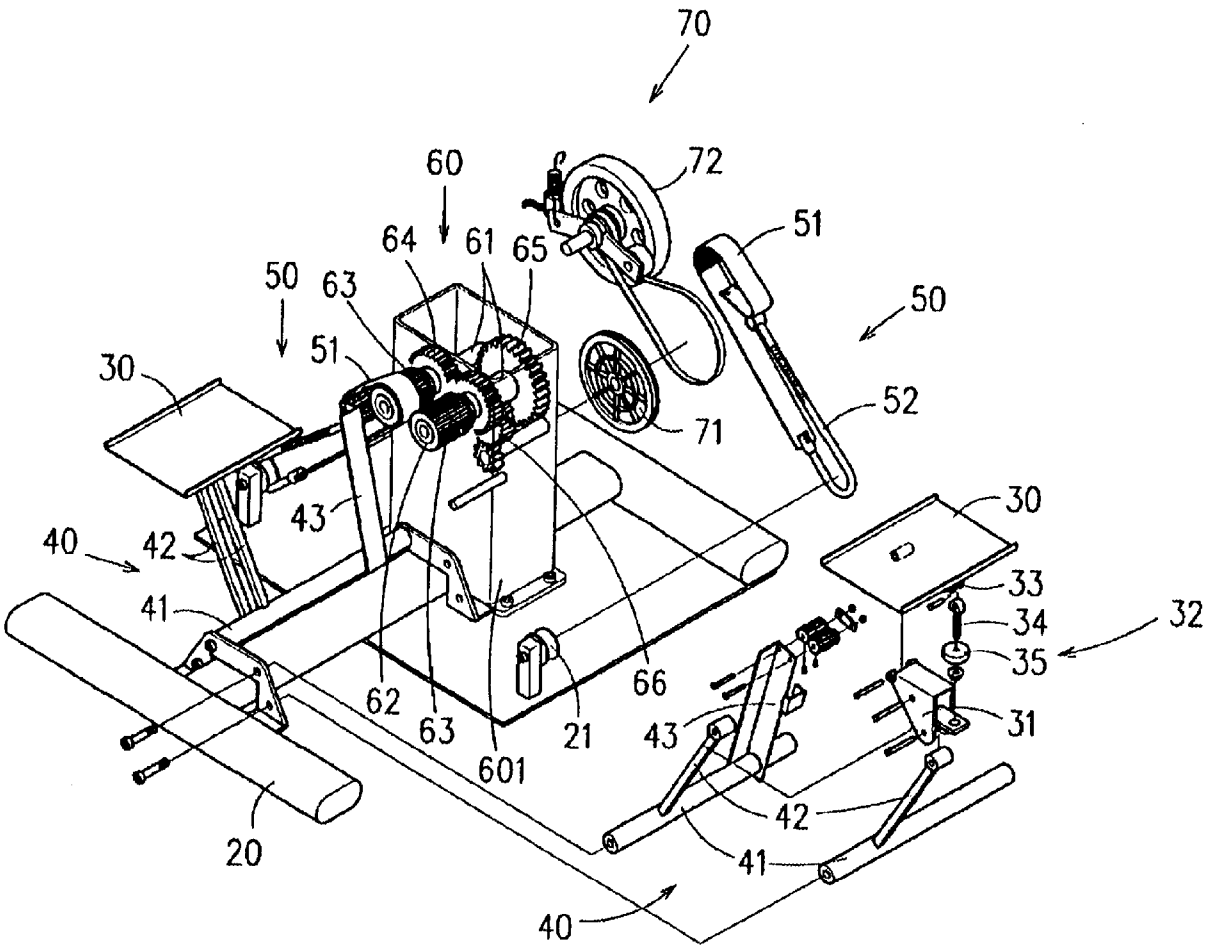
FIG. 2 shows an exploded perspective view of the present invention.
Figure 3:
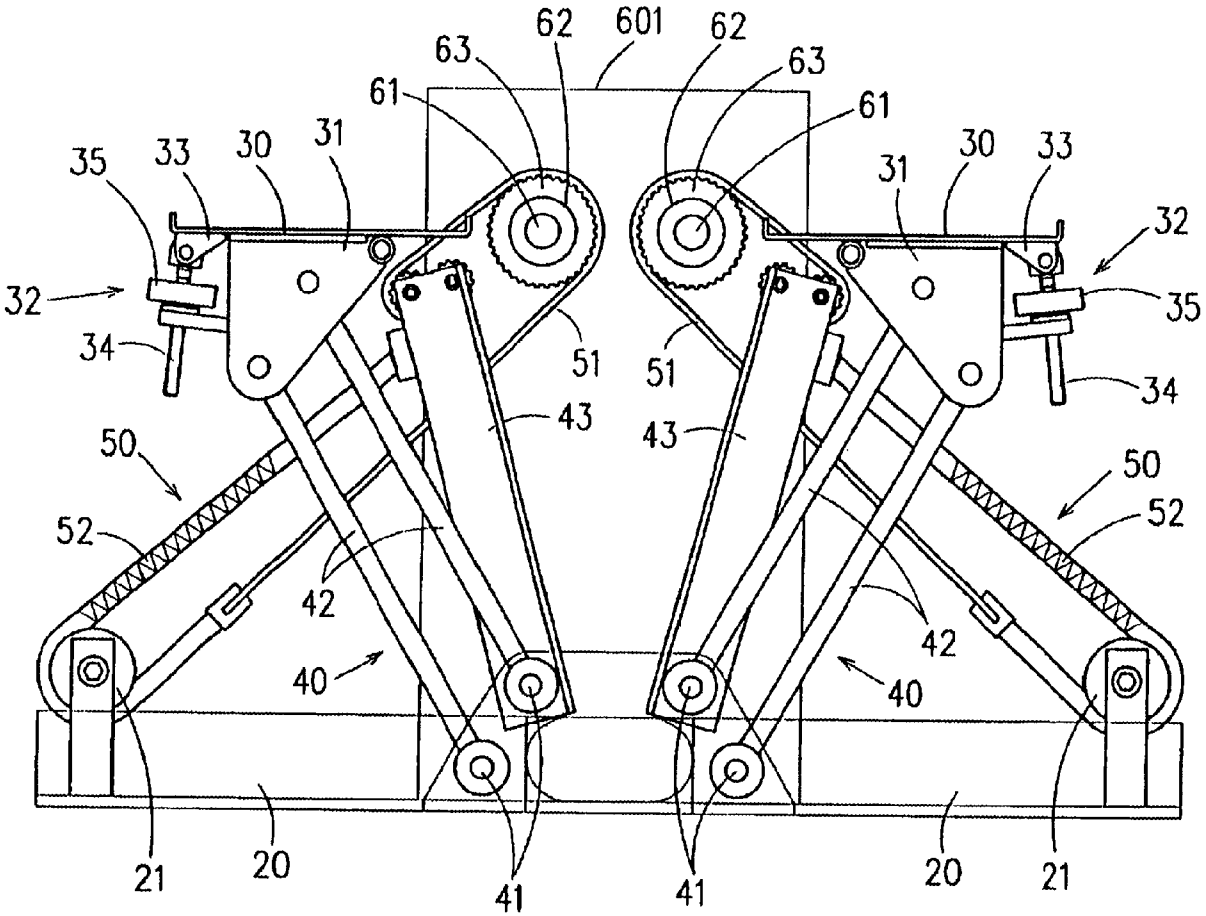
FIG. 3 shows a front view of the present invention.
Figure 4:
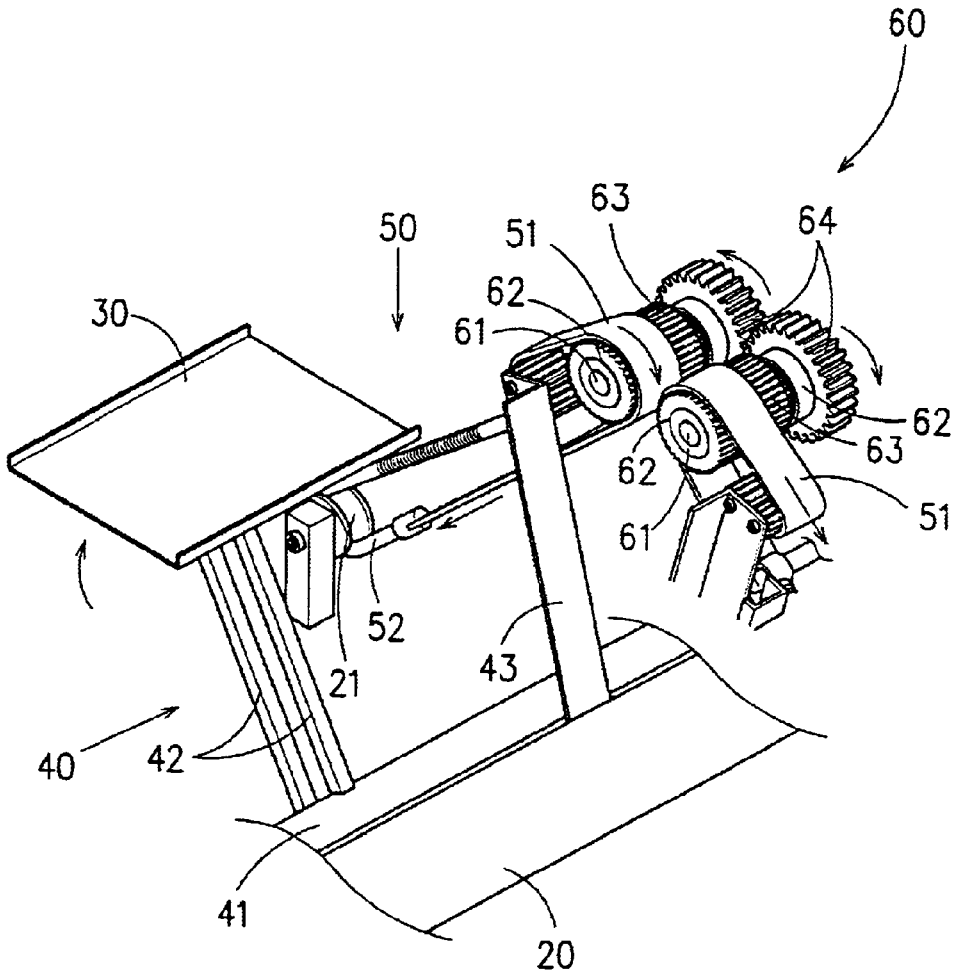
FIG. 4 shows a partial schematic view of the present invention.
Figure 5:
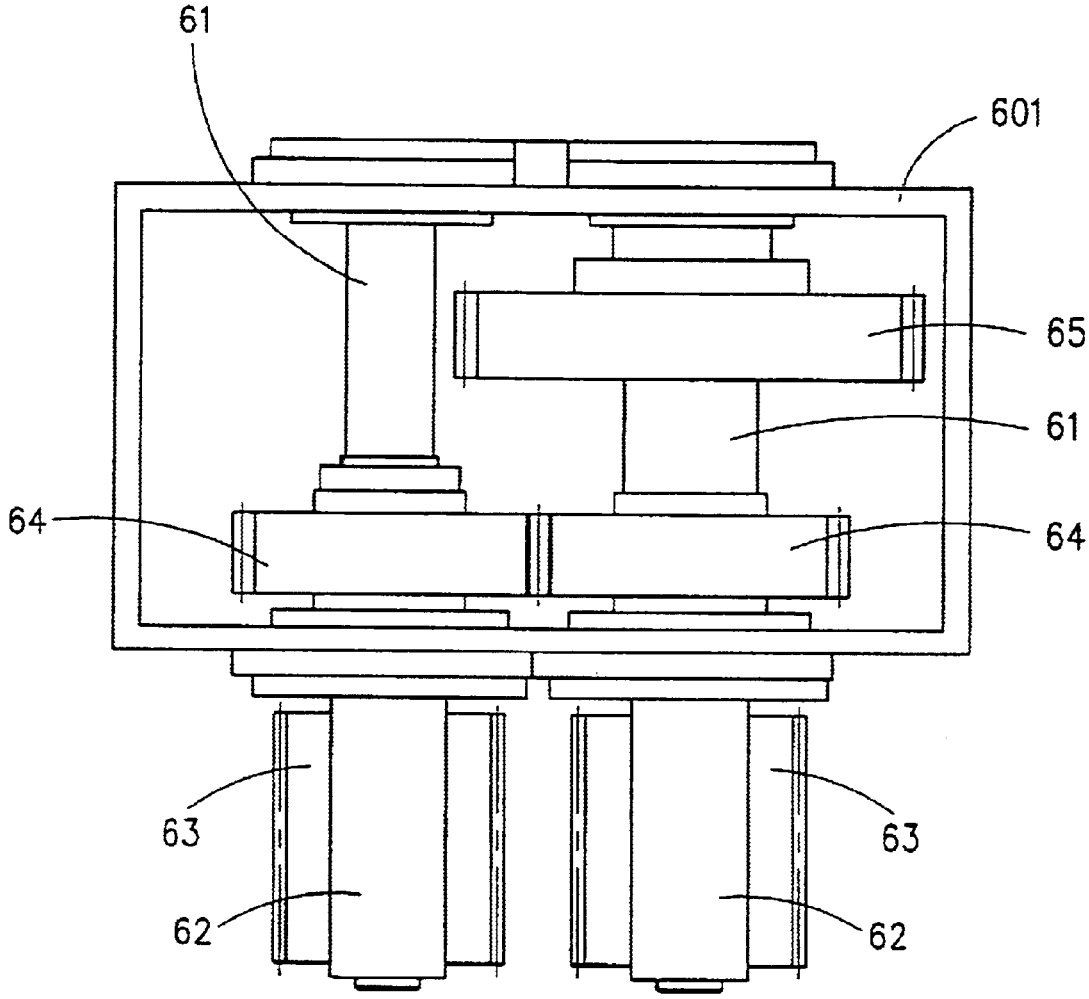
FIG. 5 shows a top view of the connection transmission device of the present invention.
Figure 6:
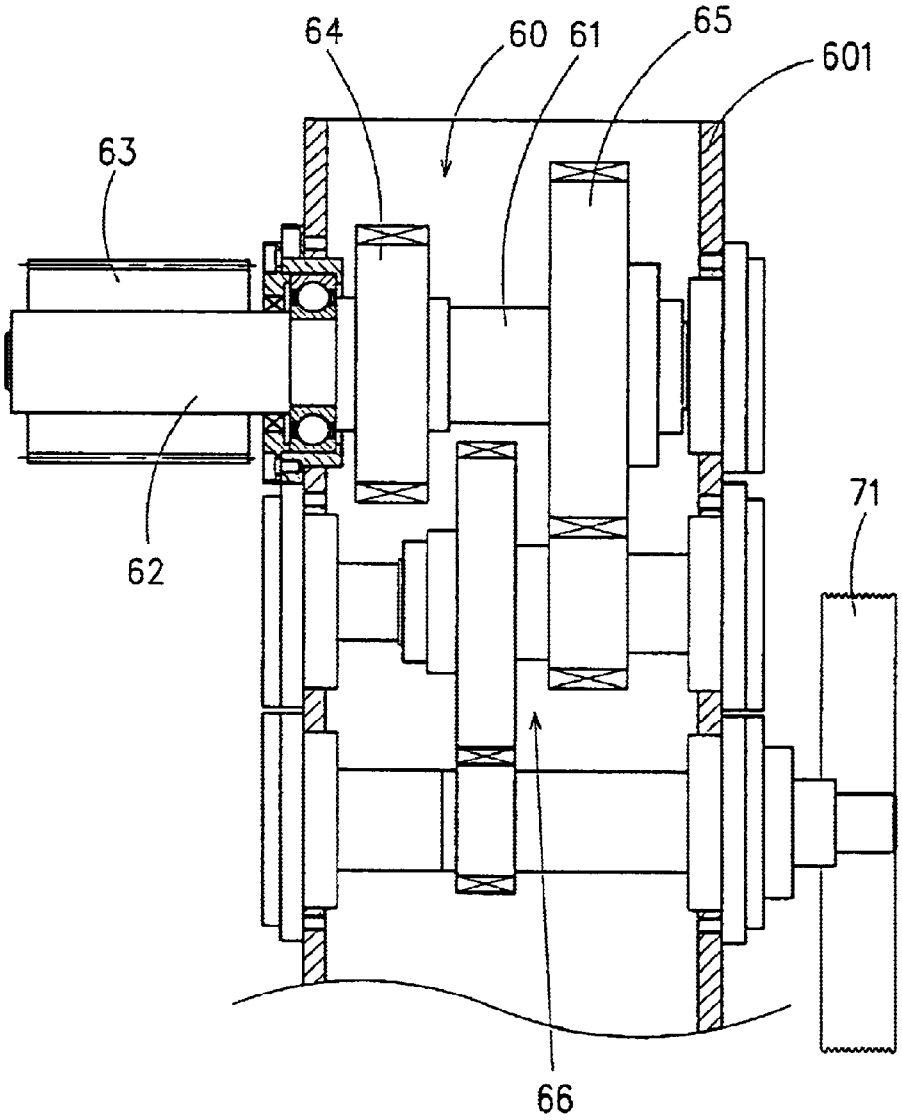
FIG. 6 shows a side view of the connection transmission device of the present invention.
Figure 7:
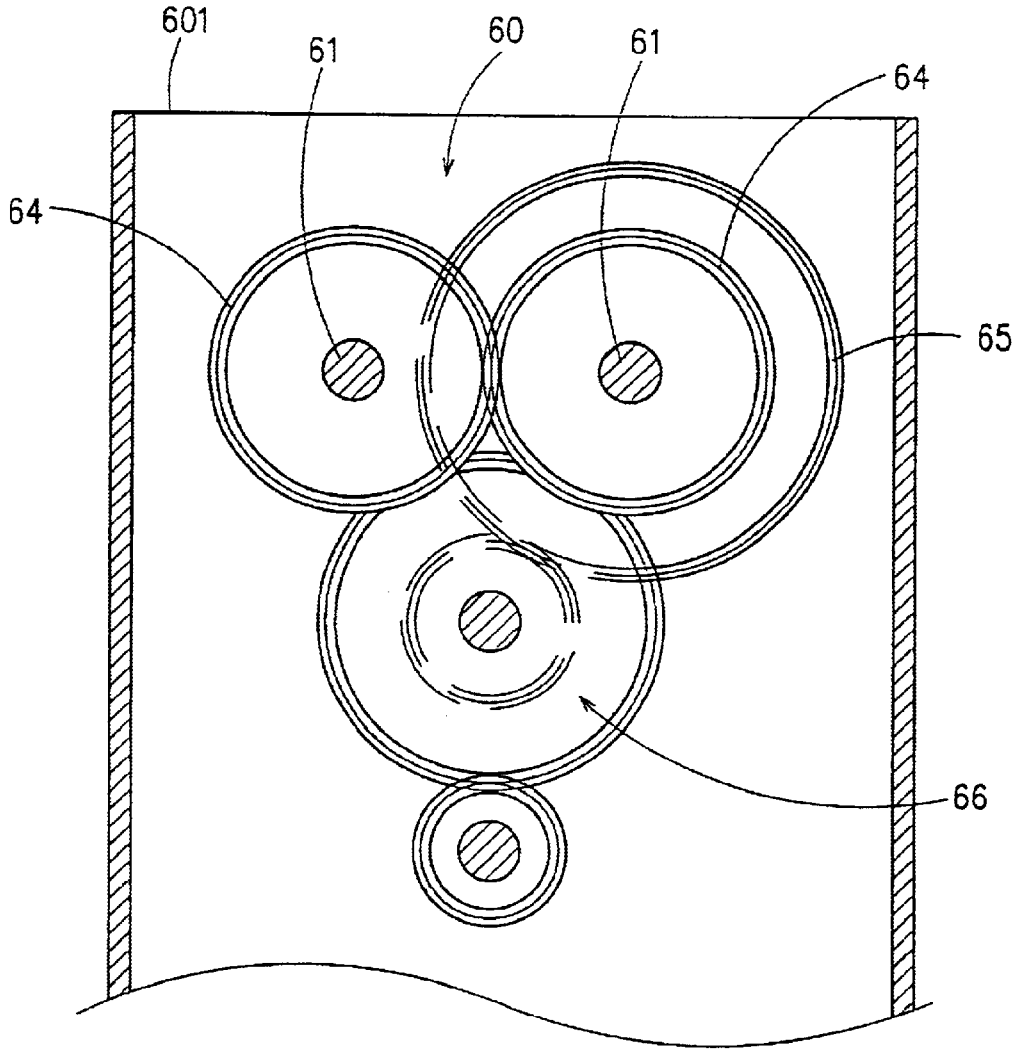
FIG. 7 shows a front view of the connection transmission device of the present invention.
Figure 8:
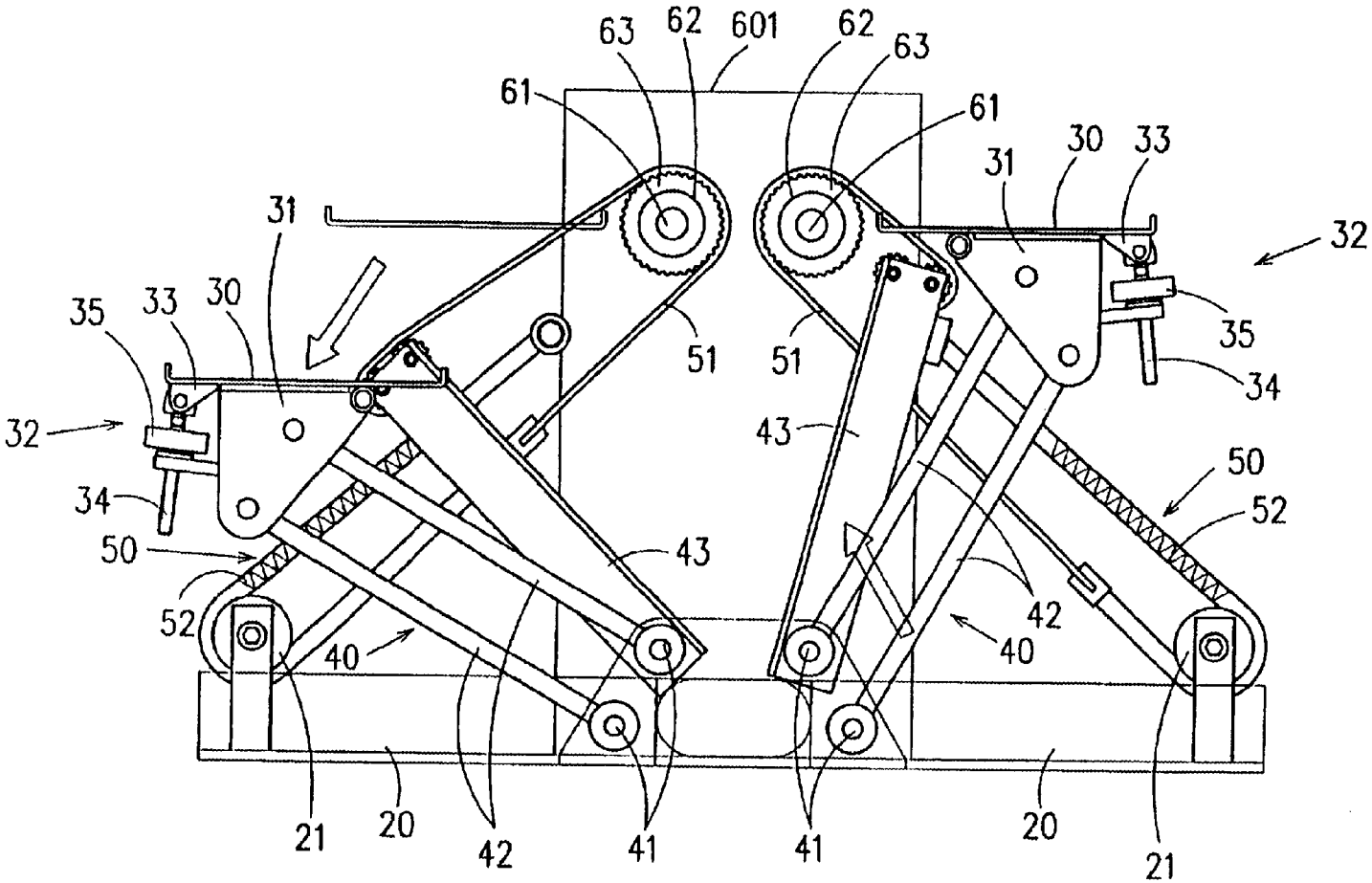
FIG. 8 shows a front schematic view of the present invention in action.
Figure 9:
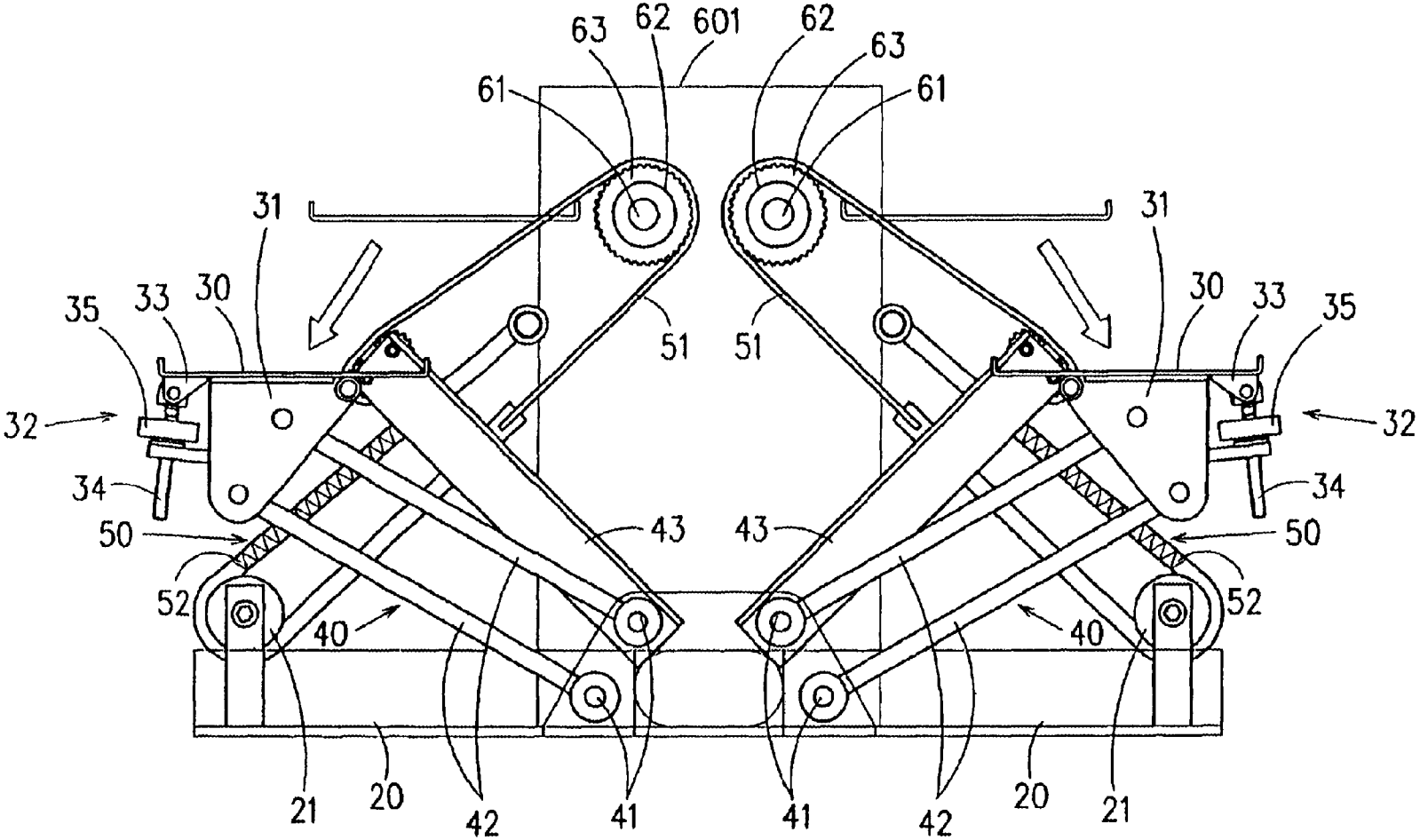
FIG. 9 shows another front schematic view of the present invention in action.

As shown in all drawings provided herewith, a walking machine of the present invention comprises a base 20, two footboards 30, two swivel devices 40, two recovery transmission devices 50, one connection transmission device 60, and one damping device 70.

The base 20 is rested on a surface for supporting other component parts of the walking machine on the surface.

The two footboards 30 are mounted at an interval on the tops of the two swivel devices 40, which are in turn mounted on the base 20 and are formed of two horizontal pivoting rods 41, two swivel arms 42 mounted slantingly on the pivoting rods 41, and a support arm 43 mounted on one of the pivoting rods 41 such that the support arm 43 swivels synchronously with the swivel arms 42.

The connection transmission device 60 comprises two shafts 61, two drive wheels 63 mounted on one end of the shafts 61 in conjunction with a one-way bearing 62, and two engagement gears 64 mounted on the other end of the shafts 61 such that the two engagement gears 64 are engaged with each other. The connection transmission device 60 further comprises a transmission gear 65, which is mounted on any one of the two shafts 61 and is engaged with a gear set 66.

The recovery transmission devices 50 comprise a transmission element 51 and a tension element 52. The transmission element 51 runs on the drive wheel 63 of the connection transmission device 60 such that the transmission element 51 is fastened with the support arm 43 of the swivel device 40. The tension element 52 is fixed at one end via a steering wheel 21.

The damping device 70 comprises a belted wheel 71 and a magnetic damping wheel 72 driven by the belted wheel 71 which is linked with the gear set 66.

In operation, the two footboards 30 are driven by two feet of an exerciser to actuate the two swivel devices 40 such that the two support arms 43 of the two swivel devices 40 actuate the two recovery transmission devices 50, thereby causing the two transmission elements 51 to act on the damping device 70 via the connection transmission device 60. In view of the cooperation of the two recovery transmission devices 50 and the connection transmission device 60, both footboards 30 share with the same damping device 70.

The walking machine of the present invention may further comprise a handrail frame 22 mounted on the base 20, and a display.23 mounted on the handrail frame 22.

The walking machine of the present invention further comprises a support frame 601, which is mounted on the base 20 to give an added support to the connection transmission device 60, with the two drive wheels 63 of the connection transmission device 63 being located in the outside of the support frame 601.

Figure 10:
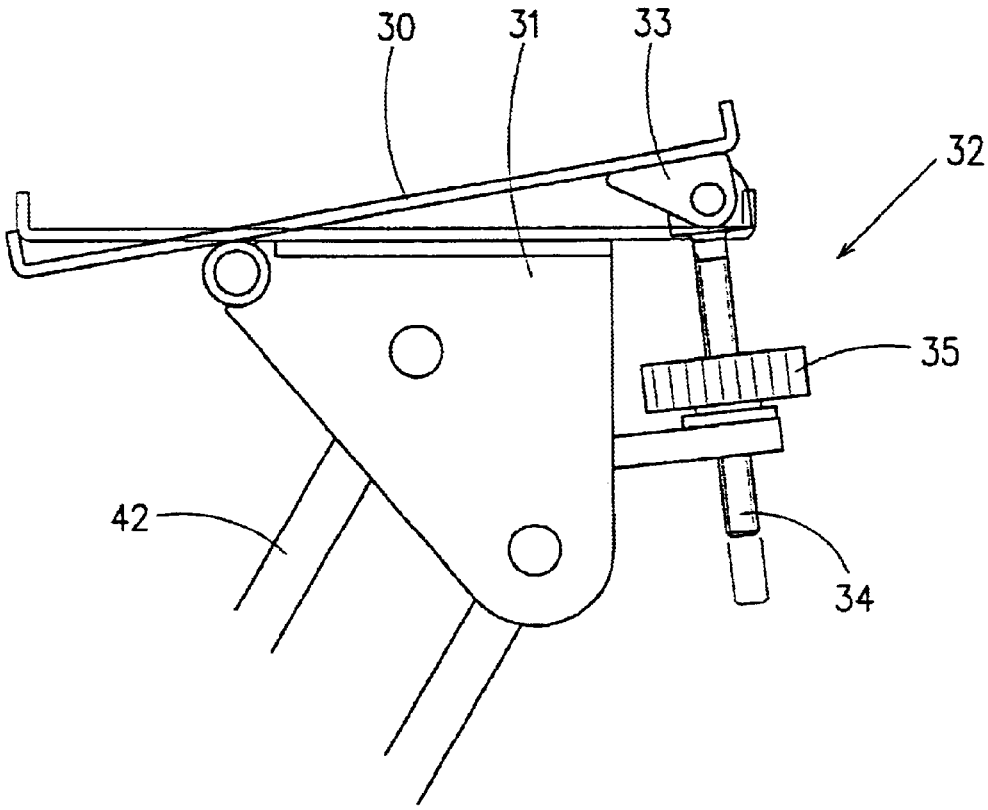
FIG. 10 shows a schematic view of the adjusting of the footboard of the present invention.

The footboards 30 of the present invention are optionally provided with an adjustment device 32 which is formed of a threaded rod 34 and an adjustment wheel 35 mounted on the threaded rod 34. The threaded rod 34 is pivoted with a lug.33 and a bottom seat 31 of the footboards 30. The footboards 30 can be tilted by the adjustment wheel 35, as illustrated in FIG. 10.

The two footboards 30 of the present invention are movable in sideway directions by virtue of the two swivel devices 40. In addition, the two footboards 30 share with the same damping device 70, thereby resulting in decrease in size and cost of the walking machine of the present invention. The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A walking machine comprising:

a base;

two swivel devices mounted on said base and comprised of two horizontal pivoting rods, two swivel arms mounted slantingly on said horizontal pivoting rods, and a support arm mounted on one of said two pivoting rods such that said support arm swivels synchronously with said two swivel arms;

two footboards mounted on said two swivel devices such that said two footboards are capable of a lateral movement;

a connection transmission device mounted on said base and comprised of two shafts, two drive wheels mounted on one of said two shafts in conjunction with a one-way bearing, and two engagement gears mounted on another end of said shafts and engaged with each other, said connection transmission device further comprising a transmission gear mounted on one of said two shafts and engaged with a gear set;

two recovery transmission devices, each comprising a transmission element and a tension element, with said transmission element running on said drive wheel of said connection transmission device such that said transmission element is fastened to said support arm of said swivel device, said tension element fixed at one end thereof via a steering wheel; and a damping device comprising a belted wheel, and a magnetic damping wheel driven by said belted wheel whereby said belted wheel is linked with said gear set;

wherein said two footboards being driven by two feet of an exerciser to actuate said two swivel devices such that said two support arms of said two swivel devices actuate said two recovery transmission devices, thereby causing said two transmission elements of said recovery transmission devices to act on said damping device via said connection transmission device.

2. The walking machine as defined in claim 1 further comprising a handrail frame mounted on said base, and a display mounted on said handrail frame.

3. The walking machine as defined in claim 1 further comprising a support frame mounted on said base to support said connection transmission device such that said two drive wheels of said connection transmission device are located in the outside of said support frame.

4. The walking machine as defined in claim 1, wherein said two footboards are comprised of an adjustment device which is comprised of a threaded rod and an adjustment wheel mounted on said threaded rod, with said threaded rod being pivoted with a lug and a bottom seat of said footboards whereby said footboards are tilted by said adjustment wheel of said adjustment device.

* * * * *